US010859084B2

(12) United States Patent
Valland et al.

(10) Patent No.: US 10,859,084 B2
(45) Date of Patent: Dec. 8, 2020

(54) SUBSEA PROCESS LUBRICATED WATER INJECTION PUMP

(71) Applicant: ONESUBSEA IP UK LIMITED, London (GB)

(72) Inventors: Åsmund Valland, Bønes (NO); Helge Dale, Rådal (NO)

(73) Assignee: ONESUBSEA IP UK LIMITED, London (GB)

( * ) Notice: Subject to any disclaimer, the term of this patent is extended or adjusted under 35 U.S.C. 154(b) by 485 days.

(21) Appl. No.: 15/138,921

(22) Filed: Apr. 26, 2016

(65) Prior Publication Data

US 2017/0306966 A1 Oct. 26, 2017

(51) Int. Cl.

| | |
|---|---|
| ***F04D 3/00*** | (2006.01) |
| ***E21B 43/20*** | (2006.01) |
| ***E21B 43/12*** | (2006.01) |
| ***F04D 29/044*** | (2006.01) |
| ***F04D 13/06*** | (2006.01) |
| ***F04D 13/08*** | (2006.01) |
| ***F04D 29/041*** | (2006.01) |

(52) U.S. Cl.

CPC ..... *F04D 3/00* (2013.01); *E21B 43/12* (2013.01); *E21B 43/20* (2013.01); *F04D 13/0606* (2013.01); *F04D 13/0653* (2013.01); *F04D 13/086* (2013.01); *F04D 29/041* (2013.01); *F04D 29/044* (2013.01)

(58) Field of Classification Search

CPC ..... F04D 3/00; F04D 29/041; F04D 43/12; F04D 13/086; F04D 13/0653; F04D 13/0606; F04D 29/044; E21B 43/20; E21B 43/12

See application file for complete search history.

(56) References Cited

U.S. PATENT DOCUMENTS

| | | | | |
|---|---|---|---|---|
| 3,022,739 A * | 2/1962 | Herrick | F04D 1/063 | 417/350 |
| 3,094,272 A * | 6/1963 | McClure | F04D 25/082 | 310/63 |
| 3,975,117 A * | 8/1976 | Carter | F04D 1/06 | 417/370 |
| 4,073,606 A * | 2/1978 | Eller | F04D 3/005 | 415/111 |
| 4,120,175 A * | 10/1978 | Dernedde | F04D 29/044 | 464/93 |

(Continued)

FOREIGN PATENT DOCUMENTS

| | | |
|---|---|---|
| DE | 858196 C | 12/1952 |
| WO | 2014042626 A1 | 3/2014 |

(Continued)

OTHER PUBLICATIONS

International Search Report and Written Opinion dated Jun. 27, 2017, for International Application No. PCT/EP2017/057541.

*Primary Examiner* — Christopher S Bobish
(74) *Attorney, Agent, or Firm* — Helene Raybaud

(57) ABSTRACT

A subsea water injection pump includes components that are cooled and lubricated by the process fluid. The pump includes opposing stages of impellers in a "back-to-back" arrangement such that the axial forces of the impeller stages partially or nearly fully offset each other. In some cases, a combination of barrier fluid and process fluid is used for lubrication and cooling.

15 Claims, 9 Drawing Sheets

(56) References Cited

U.S. PATENT DOCUMENTS

| | | | | |
|---|---|---|---|---|
| 5,655,849 | A * | 8/1997 | McEwen | F04D 13/021 403/370 |
| 5,888,053 | A * | 3/1999 | Kobayashi | F04D 1/06 417/244 |
| 6,171,483 | B1 | 9/2001 | Eden et al. | |
| 6,511,298 | B2 * | 1/2003 | Takura | F04D 3/00 417/350 |
| 8,096,782 | B2 * | 1/2012 | McCarthy | F04D 13/0606 378/200 |
| 8,961,153 | B2 * | 2/2015 | Wilson | E21B 43/01 166/105 |
| 9,841,026 | B2 * | 12/2017 | Stinessen | F04D 1/06 |
| 9,954,414 | B2 * | 4/2018 | Cunningham | E21B 41/0007 |
| 9,964,113 | B2 * | 5/2018 | Westberg | E21B 43/128 |
| 2006/0243670 | A1 | 11/2006 | Pinchin | |
| 2008/0273990 | A1 | 11/2008 | Pham et al. | |
| 2009/0217992 | A1 | 9/2009 | Wilson | |
| 2011/0044831 | A1 | 2/2011 | Cunningham et al. | |
| 2014/0205475 | A1 * | 7/2014 | Dale | F04D 13/086 417/351 |
| 2014/0241907 | A1 | 8/2014 | Grynning et al. | |
| 2016/0304371 | A1 * | 10/2016 | Wang | B01D 61/02 |

FOREIGN PATENT DOCUMENTS

| | | | |
|---|---|---|---|
| WO | 2015/103017 | A1 | 7/2015 |
| WO | 2015/123736 | A1 | 8/2015 |

* cited by examiner

SUBSEA PROCESS LUBRICATED WATER INJECTION PUMP

TECHNICAL FIELD

The present disclosure relates to subsea injection systems and methods. More particularly, the present disclosure relates to subsea systems and methods for injecting fluid into a subterranean formation.

BACKGROUND

Recovery of hydrocarbons from an oil or gas field can be enhanced by injecting fluid, for example water, into the subterranean reservoir to maintain reservoir pressure and to drive certain fractions of the hydrocarbons to producing wells. Water flooding operations generally depend upon a sufficient supply of water for injection, means for treating the source water to meet the reservoir conditions, a pumping system, and access to the formation via a wellbore.

In order to avoid large investments associated with construction and installation of surface arrangements offshore, subsea-placed production equipment is increasingly sought-after. The production stream is conveyed via pipelines to the shore or to existing remote surface structures, such as platforms.

Water injection for stimulating production from a petroleum reservoir involves pumping water at high pressure down injection wells. The high pressure water is pumped into a reservoir or formation that is in fluid communication with the reservoir. The reservoir pressure can thereby be maintained and petroleum can be forced to migrate toward the production wells. In some applications, raw seawater is injected to increase recovery by pumping seawater into the field to force the hydrocarbons to flow towards the production wells.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a subsea process fluid lubricated water injection pumping system is described. The pumping system includes: an elongated impeller shaft; an electric motor configured to impart torque on the impeller shaft thereby causing the impeller shaft to rotate about a main longitudinal axis in a drive direction; a first set of impellers fixedly mounted to the impeller shaft and configured to increase pressure of a first single phase process fluid when the impeller shaft is rotated in the drive direction thereby imparting a first axial force on the impeller shaft in a first direction parallel to the longitudinal axis; a second set of impellers fixedly mounted to the impeller shaft and configured to increase pressure of a second single phase process fluid when the impeller shaft is rotated in the drive direction, thereby imparting a second axial force on the impeller shaft in a second direction opposite to the first direction; and at least one bearing surface that is configured to allow the impeller shaft to rotate about the longitudinal axis is lubricated and cooled by the process fluid.

During operation the net axial force on the impeller shaft can have a magnitude of less than about 50-75% of the greater magnitude of the first or second axial forces. According to some embodiments, the pumping system is configured for deployment on the seabed and the first and second process fluids are seawater. The seawater can be filtered to remove at least some particulate matter (e.g. greater than 1 micron in size) prior to entering the pumping system.

The first and second sets of impellers can be positioned on the same side or opposite sides of the electric motor. The electric motor can include a rotor shaft that is attached to the impeller shaft with a flexible coupling, or the motor can be fixedly mounted directly to the impeller shaft. According to some embodiments, a second motor is included to also drive the impeller shaft. A thrust disk can be fixedly mounted to the impeller shaft having bearing surfaces that are lubricated with the first or second process fluids. The electric motor can include a canned rotor thereby allowing the rotor to be exposed to the process fluids.

According to some embodiments, the first and second sets of impellers are arranged in series and serve as a single pump seawater injection system, and the first process fluid and the second process fluid are the same fluid. The first and second sets of impellers can be arranged in parallel or in series and can serve as a single pump seawater injection system, and the first process fluid and the second process fluid are the same fluid.

According to some other embodiments, the pumping system forms part of seawater injection system and at least one of the impeller stages is configured to inject seawater into a subterranean rock formation via a wellbore penetrating the formation. According to some embodiments, the first and second sets of impellers serve as two pumps in separate parts of the seawater injection system. In such cases, cross contamination between the first and second process fluids can be controlled using a high pressure water source injected into a location between the first and second sets of impellers.

According to some embodiments, all bearing surfaces are configured to be lubricated and cooled by at least the first or second process fluids. According to some other embodiments, the electric motor is configured to be lubricated and cooled by a barrier fluid.

BRIEF DESCRIPTION OF THE DRAWINGS

The subject disclosure is further described in the following detailed description, and in the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
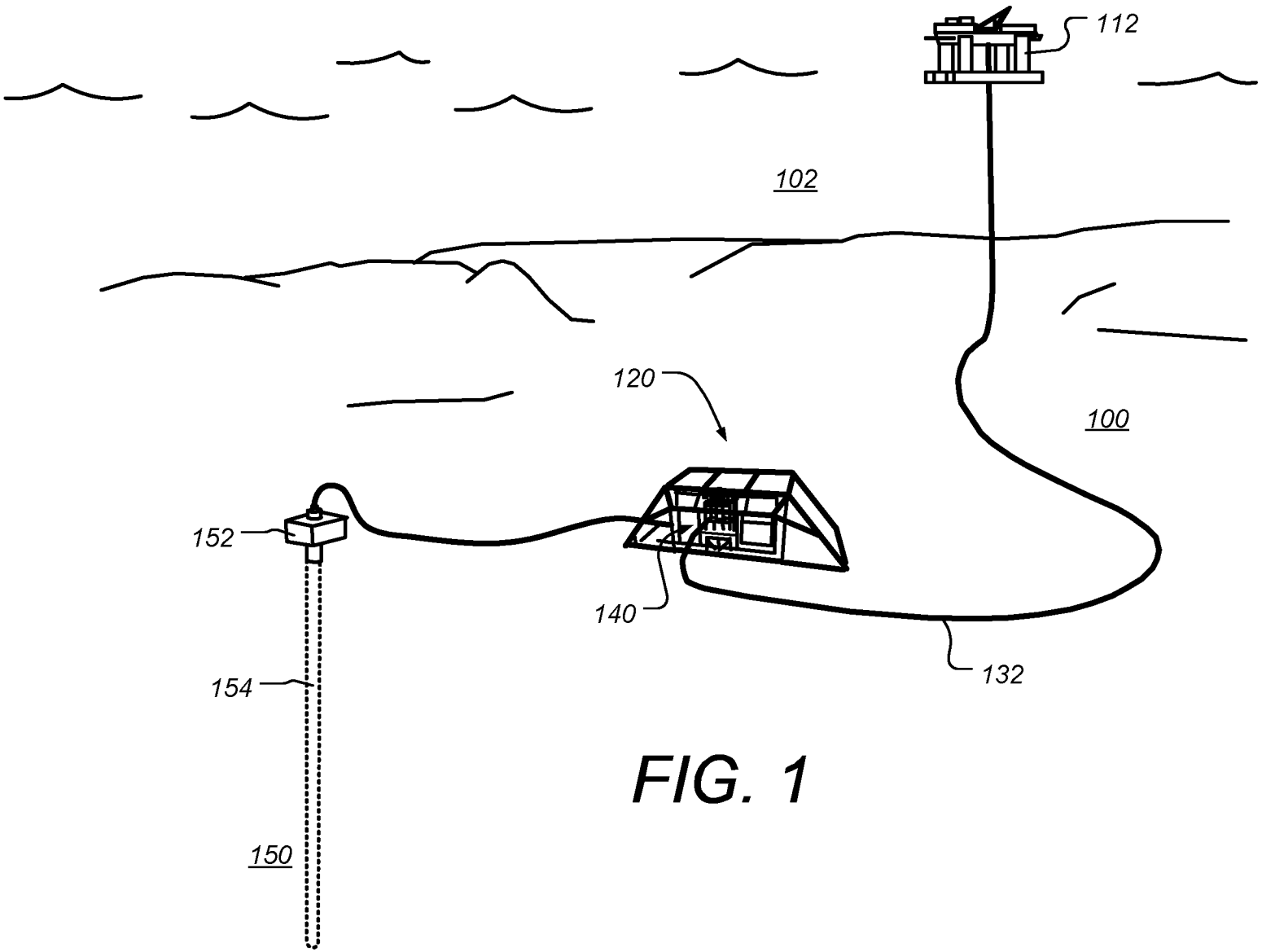
FIG. 1 is a schematic diagram illustrating a subsea environment in which a process fluid lubricated injection pump can be deployed, according to some embodiments.

One or more specific embodiments of the present disclosure will be described below. The particulars shown herein are by way of example, and for purposes of illustrative discussion of the embodiments of the subject disclosure only, and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are used in an open-ended fashion, and thus should be interpreted to mean "including, but not limited to." Also, any use of any form of the terms "connect," "engage," "couple," "attach," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name, but not function.

According to some embodiments, injection of raw seawater is used to increase recovery of hydrocarbons from a subterranean formation by pumping seawater into the formation to force the hydrocarbons to flow towards the production wells. The increased pressure in the field will also stimulate production.

According to some embodiments, process fluid is used for lubrication and cooling in various subsea single phase pump designs. The process fluid will be seawater with levels of particles, salt, temperature depending on location and filtering upstream from the pump.

According to some embodiments, the pump components are cooled and lubricated entirely by the process fluid. According to some embodiments, the pumps include opposing stages of impellers in a "back-to-back" arrangement such that the axial forces of the impeller stages partially or fully offset each other. According to some embodiments, a combination of barrier fluid and process fluid is used for lubrication and cooling.

Removing and/or reducing barrier fluid systems may simplify pump design, lower the number of components, lower costs, and/or reduce or eliminate barrier fluid leakage into the process fluid stream.

FIG. 1 is a diagram illustrating a subsea environment in which a process fluid lubricated injection pump can be deployed, according to some embodiments. On sea floor 100 a subsea station 120 is shown which is near wellhead 152 for injection well 154. Injection well 154 may be used to increase recovery of hydrocarbons from a subterranean formation 150, as well as to increase pressure in the field to further stimulate production. Station 120 includes a subsea water injection system 140, which is powered by one or more electric motors, such as permanent magnet motors. The station 120 is connected to an umbilical cable, such as umbilical 132, which supplies power to the electric motors in station 120. The umbilical in this case is being run from a platform 112 through seawater 102, along sea floor 100 to station 120. In other cases, the umbilicals may be run from some other surface facility such as a floating production, storage and offloading unit (FPSO), or a shore-based facility. According to some embodiments, umbilical 132 is also used to supply barrier fluid to station 120. The umbilical 132 can also be used to supply other fluids to station 120, as well as include control and data lines for use with pumps and other subsea equipment in station 120.

According to some embodiments, the subsea injection equipment is located at the seabed relatively close to the wellhead to lower costs and losses of the high pressure piping downstream of the pumps.

According to some embodiments, raw seawater is used for the injection. As the seawater is likely to contain impurities such as particles, algae, oxygen and sulfate, seawater injection system 140 may reduce these impurities to an acceptable level prior to injection. The water treatment will thus avoid blocking the filters and reducing injectivity of the reservoir. For example, seawater injection system 140 can include a particle strainer, a particle filter and a micro filter for removing particles of 1.0 or 0.1 microns in size from the injection fluid. According to some embodiments, the system 140 also includes a nano filter that is configured to remove sulfates and/or dissolved salt from the water being injected into formation 150. For further details of subsea water injection systems, see commonly owned and co-pending patent application entitled "Subsea Fluid Injection System," U.S. application Ser. No. 15/138,850, filed on even date herewith, Publication No. US 2017/0267545, and which is incorporated by reference herein (hereinafter "the Co-Pending Application").

According to some embodiments, injection system 140 includes one or more pumps that are cooled and lubricated partially or entirely by the process fluid. The pump(s) can include opposing stages of impellers in a "back-to-back" arrangement, which is described in further detail below, such that the axial forces of the impeller stages partially or fully offset each other.

Figure 2:
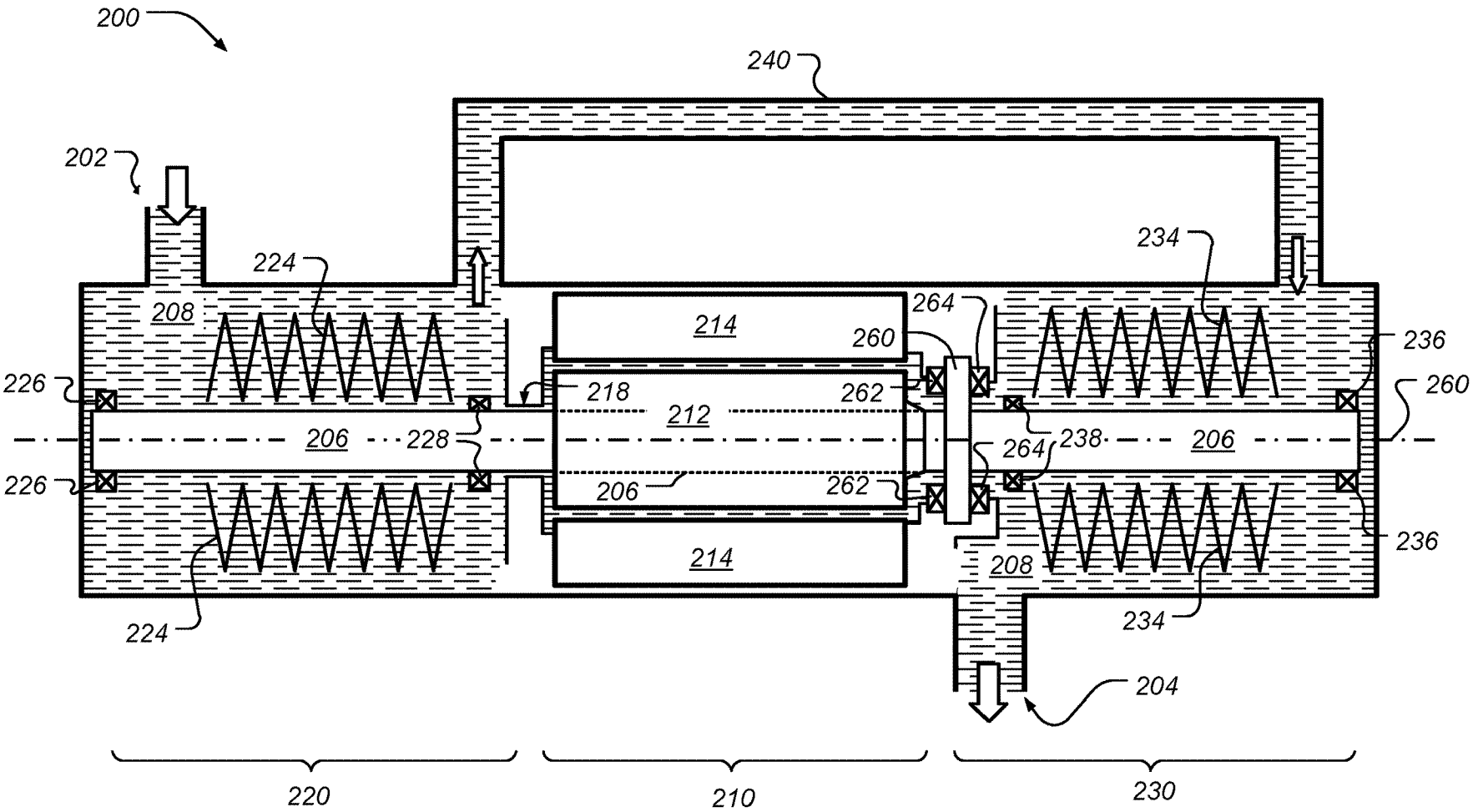
FIG. 2 is a schematic diagram illustrating aspects of a subsea process lubricated water injection pump with a center-mounted motor, according to some embodiments.

FIG. 2 is a schematic diagram illustrating aspects of a subsea process lubricated water injection pump with a center-mounted motor, according to some embodiments. Pump system 200 is, for example, deployed in a seabed location such as in injection system 140 shown in FIG. 1. Pump system 200 includes a motor section 210 and two pump sections 220 and 230. In the case shown in FIG. 2, all the bearings in pump system 200 are submerged in process fluid. Pump system 200 in FIG. 2 is an example of a back-to-back pump with one continuous motor and pump shaft with no flexible couplings or mechanical seals. All of the bearings are lubricated and cooled by process fluid 208. The motor section 210 is center-mounted. Additionally, the motor rotor 212 is submerged and is configured to be process fluid tolerant. A continuous shaft 206 goes through the motor section 210 and both pump sections 220 and 230. Pump components such as the impeller stages 224 and 234, the permanent magnets of motor rotor 212 and the thrust disk 260 are assembled to the shaft 206.

According to some embodiments, motor section 210 is a canned motor with permanent magnet motor (PM) rotor 212. In a canned motor, the "can" hermetically separates the stator chamber from the process fluid 208. A PM rotor 212 allows a wider gap between the stator 214 and the rotor 212 that further allows for a canning design. According to some embodiments, other alternatives for a water tolerant motor 210 include using a cable wound stator 214.

Pump section 220 using impeller stages 224 draws the seawater process fluid 208 from inlet 202 and drives it out through conduit 240. Similarly, pump section 230 using impeller stages 234 draws the seawater process fluid 208 from conduit 240 and drives it out through outlet 204. In embodiments, half of the impeller/diffusor stages (e.g. 224) are at one end of the machine, the other half (e.g. 234) are at other end of the machine. Hence half of the total delta (differential) pressure over the pump will be generated in each end of the machine. The direction of the impellers, and thus the thrust forces, are therefore in opposite directions for the two pump sections 220 and 230. Thrust forces will be mostly canceled due to this back-to-back layout. A pair of thrust bearings 262 and 264 on thrust disk 260 handle the residual axial forces. Radial bearings 226, 228, 236 and 238 along shaft 206 secure the radial position of the rotating assembly.

In embodiments, there may be process fluid flow (or a "leakage") from the outlet pressure of pump section 230 to the outlet of the pump section 220 through the motor section 210. The rate of the leakage can be restricted by a bushing 218 with a small gap. This restrictor 218 can be positioned on either end of the motor section 210. In both cases the leakage will go through the gap separating the rotor 212 and the stator 214, and will provide cooling of the motor section 210. The drive end radial bearings 228 and 238 and the thrust bearings 262 and 264 will also be lubricated and cooled by the leakage. The non-drive end bearings 226 and 236 will also be cooled and lubricated by the seawater process fluid 208. Note that many of the components including bearings, bushings and impeller stages are shown in cross-section and therefore appear both above and below the central longitudinal axis 260. Throughout this disclosure, for simplicity and clarity, in some cases only the upper or lower portion of the component is labeled with a reference numeral although it is understood that both upper and lower portions are part of the same component.

Figure 3:
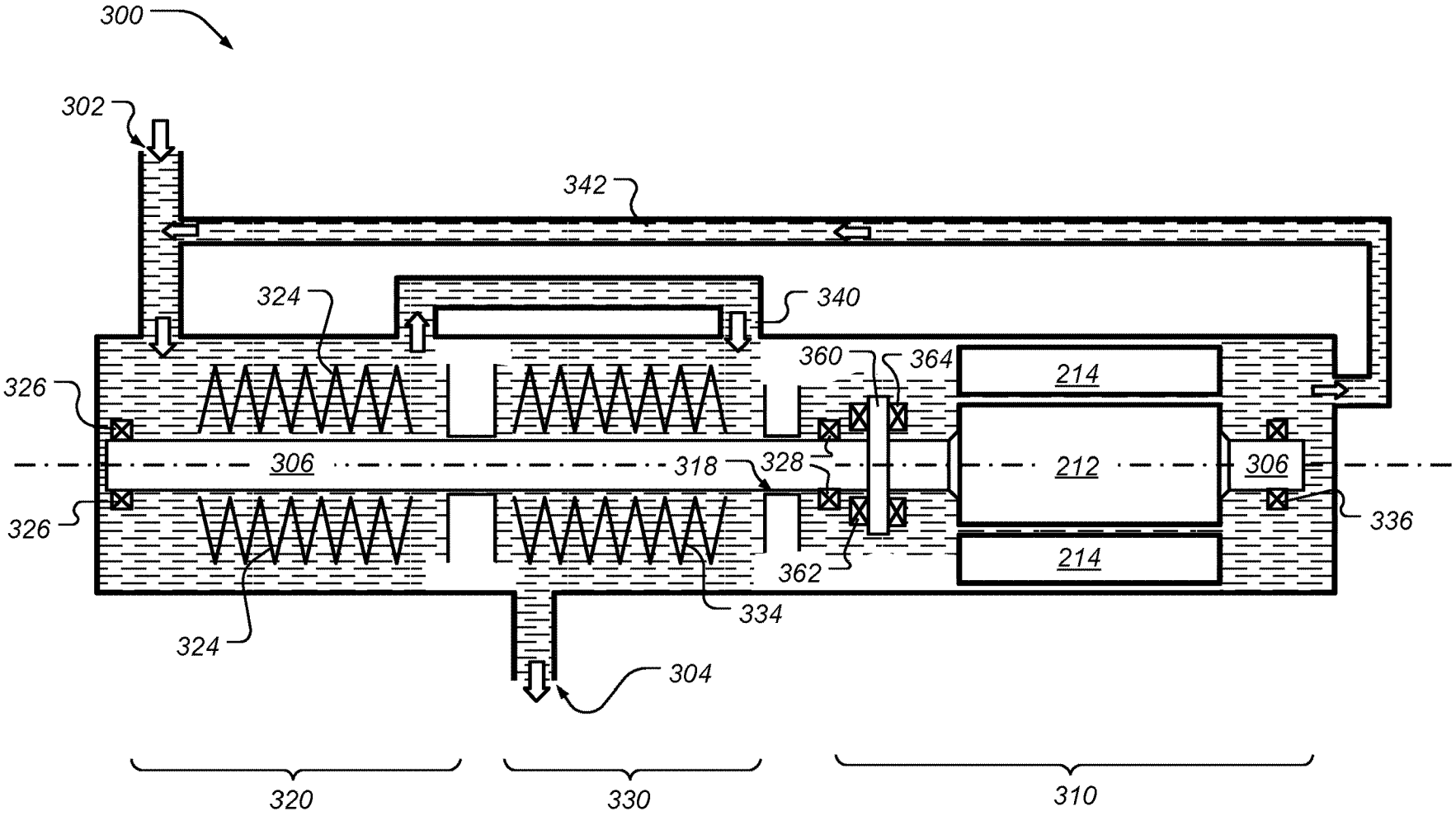
FIG. 3 is a schematic diagram illustrating aspects of a subsea process lubricated water injection pump with an end-mounted motor, according to some embodiments.

FIG. 3 is a schematic diagram illustrating aspects of a subsea process lubricated water injection pump with an end-mounted motor, according to some embodiments. The pump system 300 is similar to pump system 200 shown in FIG. 2 in that it includes back to back pump sections, has one motor, a continuous pump shaft, no flexible coupling or mechanical seals. All bearings are lubricated and cooled by seawater process fluid. In pump system 300, however, the motor section 310 is located at the end of the continuous shaft 306 and not in the center. Pump section 320 uses impeller stages 324 to draw fluid from inlet 302 and drive it into conduit 340. Pump section 330 draws fluid from conduit 340 and drives it out through outlet 304. As in the case of pump system 200 of FIG. 2, pump system 300 includes a back-to-back impeller arrangement, wherein the impeller stages 324 and 334 in pump sections 320 and 330, respectively, are arranged such that the axial thrust generated in the pump sections tends to cancel each other out. As in the case of pump system 200 of FIG. 2, a pair of thrust bearings 362 and 364 on thrust disk 360 handle the residual axial forces. Radial bearings 326, 328 and 336 along shaft 306 secure the radial position of the rotating assembly. The leakage from the inlet of pump section 330, over end bushing 318 and to the inlet of the pump section 320 via conduit 342, will lubricate and cool the radial bearings 336 and 328, the thrust bearings 362 and 364 and the motor section 310.

Figure 4:
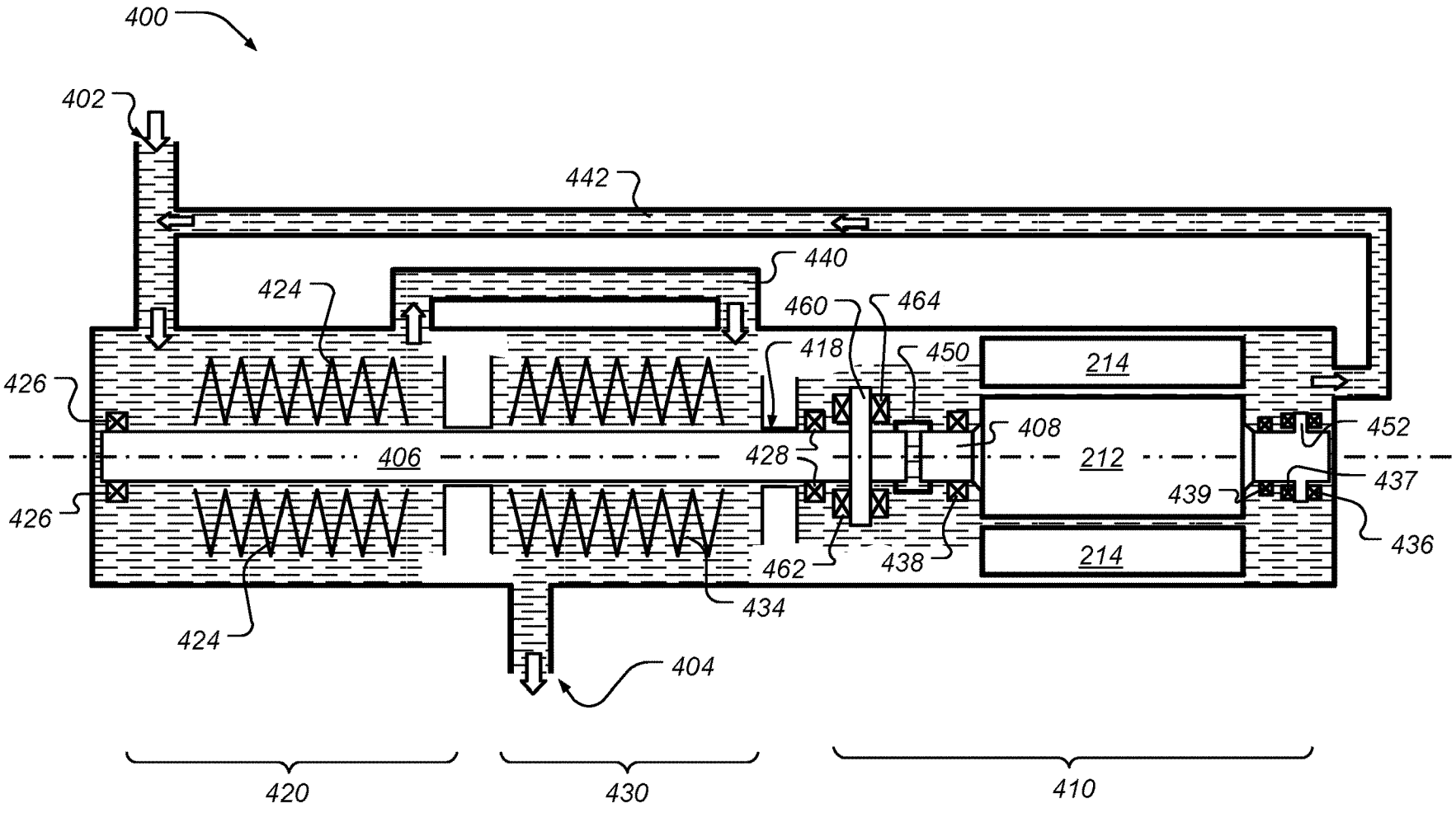
FIG. 4 is a schematic diagram illustrating aspects of a subsea process lubricated water injection pump with an end-mounted motor, according to some embodiments.

FIG. 4 is a schematic diagram illustrating aspects of a subsea process lubricated water injection pump with an end-mounted motor, according to some embodiments. Pump system 400 is similar pump system 300 of FIG. 3 in that it includes back-to-back pump sections and has one end-mounted motor. However, in pump system 400 the continuous shaft is replaced with a pump shaft 406 and a motor shaft 408 that are coupled with a flexible coupling 450. As in the case of pump systems 200 and 300 of FIGS. 2 and 3 respectively, pump system 400 includes a back-to-back impeller arrangement, wherein the impeller stages 424 and 434 in pump sections 420 and 430 respectively are arranged in series via conduit 440 such that the axial thrust generated in the pump sections tends to cancel each other out. A pair of thrust bearings 462 and 464 on thrust disk 460 handle the residual axial forces on pump shaft 406. Radial bearings 426 and 428 secure the radial position of the pump shaft 406. In the case of motor shaft 408, a pair of thrust bearings 436 and 437 on thrust disk 452 secure the axial position, and radial bearings 438 and 439 secure the radial position. The leakage from the inlet of pump section 430, over end bushing 418 and to the inlet 402 of the pump section 420 via conduit 442, will lubricate and cool the radial bearings 428, 438 and 439, the thrust bearings 462, 464, 436 and 437, flexible coupling 450 and motor section 410. The flexible coupling 450 may be configured to be water tolerant. Both the motor shaft 408 and the pump shaft 406 each may have their own thrust bearings and a pair of radial bearings.

Figure 5:
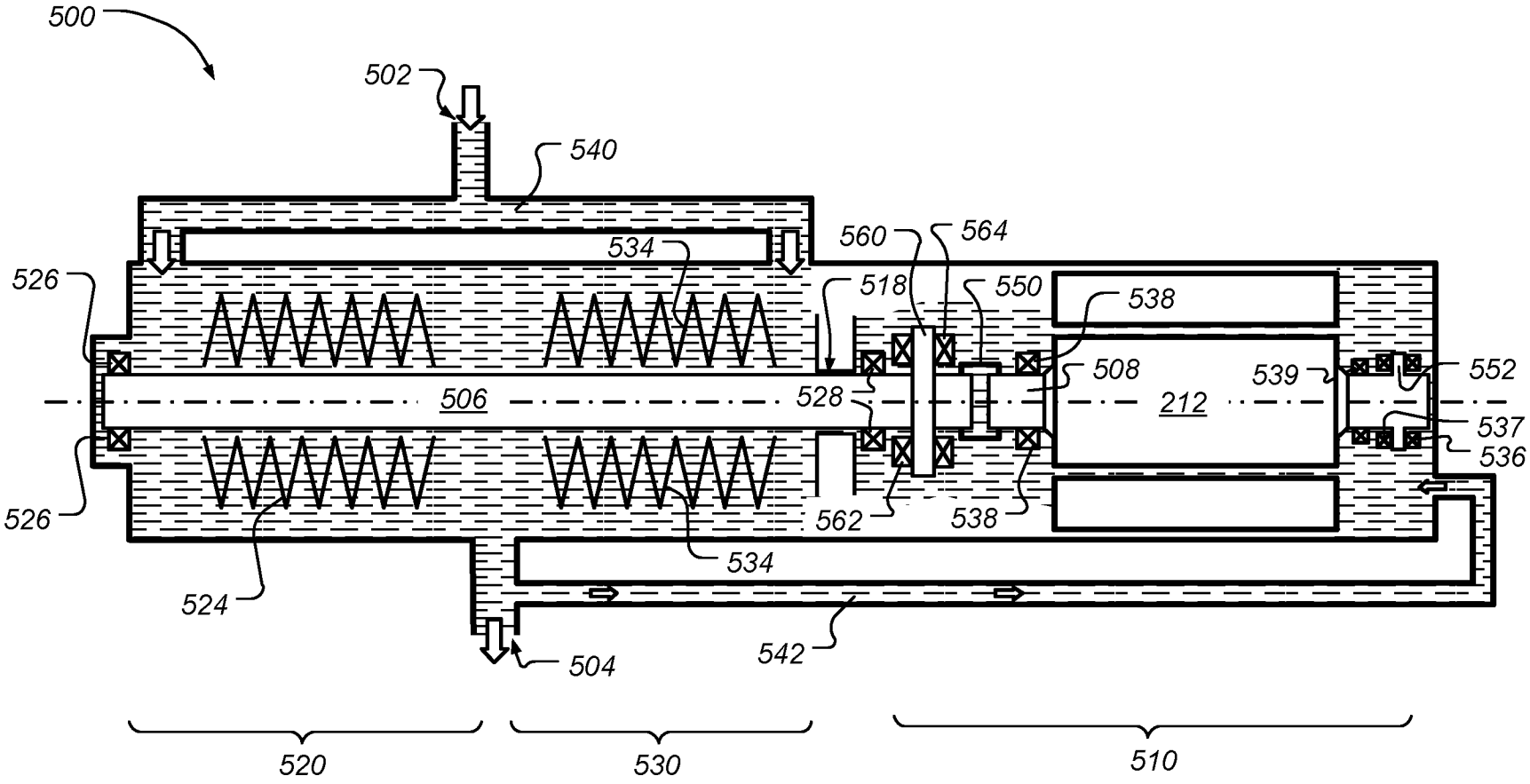
FIG. 5. is a schematic diagram illustrating aspects of a subsea process lubricated water injection pump with parallel pump sections, according to some embodiments.

FIG. 5 is a schematic diagram illustrating aspects of a subsea process lubricated water injection pump with parallel pump sections, according to some embodiments. Pump system 500 is similar to pump systems 200, 300 and 400 of FIGS. 2, 3 and 4, respectively, in that it includes back-to-back pump sections. However, in pump system 500 the two pump sections 520 and 530 are arranged in parallel. A common pump inlet 502 feeds into inlet conduit 540 that has branches to the suction sides of each of the pump sections 520 and 530. Parallel arrangement of pump sections 520 and 530 achieves greater capacity at the expense of delta pressure over the pump. As in the case of pump systems 200, 300 and 400 of FIGS. 2, 3 and 4 respectively, pump system 500 includes a back-to-back impeller arrangement, wherein the impeller stages 524 and 534 in pump sections 520 and 530 respectively are arranged such that the axial thrust generated in the pump sections tends to cancel each other out. A pair of thrust bearings 562 and 564 on thrust disk 560 handle the residual axial forces on pump shaft 506. Radial bearings 526 and 528 secure the radial position of the pump shaft 506. In the case of motor shaft 508, a pair of thrust bearings 536 and 537 on thrust disk 552 secure the axial position, and radial bearings 538 and 539 secure the radial position. The leakage is routed from higher pressure at outlet 504 to the lower pressure of the suction side of pump section 530 via conduit 542 and motor section 510. The leakage restriction can be located before or after the motor. In the case of FIG. 5 the leakage restriction is at bushing 518 between the motor section 510 and the suction side of pump section 530. The leakage lubricates and cools the bearings 528, 536, 537, 538, 539, 562 and 564, flexible coupling 550 and motor section 510.

Figure 6:
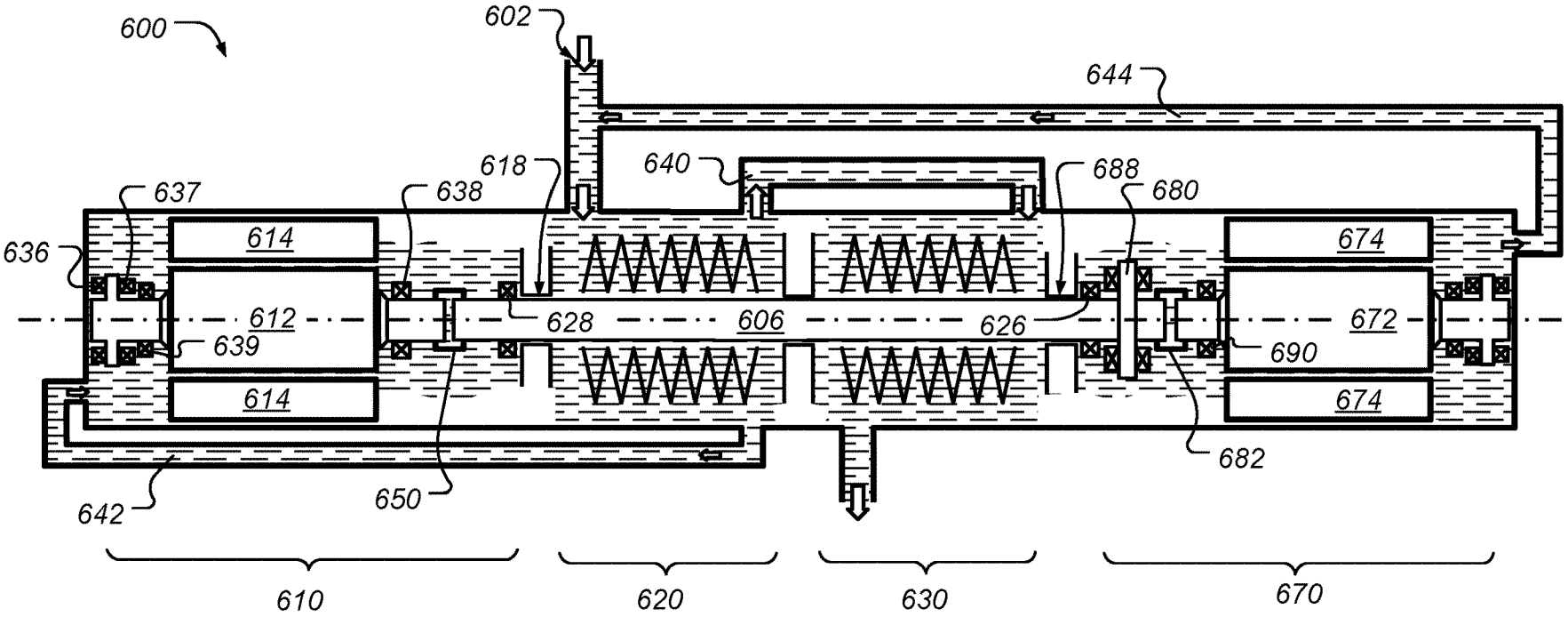
FIG. 6 is a schematic diagram illustrating aspects of a subsea process lubricated water injection pump with two motor sections, according to some embodiments.

FIG. 6 is a schematic diagram illustrating aspects of a subsea process lubricated water injection pump with two motor sections, according to some embodiments. Pump system 600 is similar to pump systems 200, 300, 400 and 500 of FIGS. 2, 3, 4 and 5, respectively, in that it includes back-to-back pump sections 620 and 630. However, pump 600 includes two motor sections 610 and 670. Motor section 610 includes rotor 612 and stator 614, while motor section 670 includes rotor 672 and stator 674. The motors can be similar or identical to motor 210 described in FIG. 2. Thus both motor sections 610 and 670 are coupled to the pump shaft 606 from the opposite sides. Providing two motors increases available pump torque. Although the layout of the pump sections 620 and 630 are shown in series connected via conduit 640, according to some embodiments the dual motor configuration of FIG. 6 can also be applied to pump sections that are arranged in parallel, such as pump sections 520 and 530 in FIG. 5. As in the case of pump systems 200, 300, 400 and 500, pump system 600 includes a back-to-back impeller arrangement wherein the impeller stages in each of the pump sections 620 and 630 are arranged such that the axial thrust generated in the pump sections tends to cancel each other out. A thrust disk 680 and associated thrust bearings handle the residual axial forces on pump shaft 606. Radial bearings 626 and 628 secure the radial position of the pump shaft 606. Radial bearings 638 and 639, and thrust bearing 636 and 637 secure the radial and axial position, respectively, of the shaft of motor section 610. Similar or identical bearings secure the position of the shaft of motor section 670. Leakage for each motor section is provided. The leakage through motor section 610 is routed from higher pressure at outlet side of pump section 620 to the lower pressure of the suction side of pump section 620 via conduit 642. The leakage through motor section 670 is routed from the higher pressure suction side of pump section 630 to the lower pressure of inlet 602 via conduit 644. The leakage restrictions can be located before or after the respective motors, and in this case they are at bushings 618 and 688 for motor sections 610 and 670 respectively. The leakages lubricate and cool the various bearings (e.g. bearings 626, 628, 636, 637, 638, 639 and 690) as well as flexible couplings 650 and 682 and motor sections 610 and 670.

Figure 7:
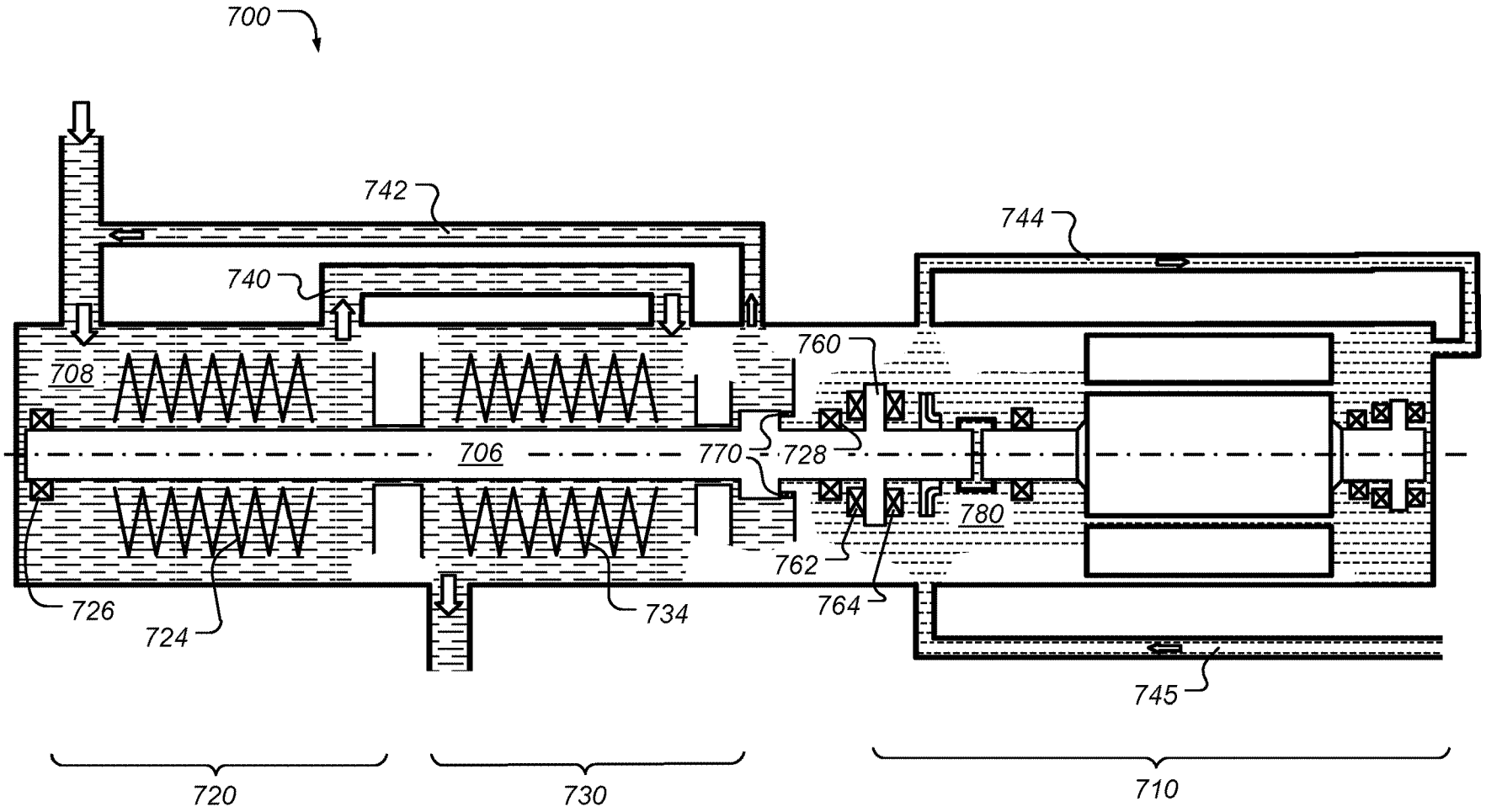
FIG. 7 is a schematic diagram illustrating aspects of a subsea water injection pump that is partially process fluid lubricated and partially barrier fluid lubricated, according to some embodiments.

FIG. 7 is a schematic diagram illustrating aspects of a subsea water injection pump that is partially process fluid lubricated and partially barrier fluid lubricated, according to some embodiments. Pump system 700 is similar to pump systems 200, 300, 400, 500 and 600 previously described, in that it includes back-to-back pump sections 720 and 730. However, pump system 700 is partially process fluid lubricated and partially barrier fluid lubricated. Motor section 710 is submerged in barrier fluid 780, while the non-drive end of the pump shaft 706 has a radial bearing 726, which is cooled and submerged in process fluid 708.

When compared to conventional subsea pumps that are fully lubricated using barrier fluid, the hybrid design such as shown in FIG. 7 that is partially process fluid lubricated offers lower consumption of barrier fluid, as well as simplification of the pump design by lowering the number of components and thus shaft length. A process fluid lubricated radial bearing 726 is assembled at the non-drive end of the pump system 700. The pump system 700 is shown as a back-to-back design wherein the impeller stages 724 and 734 of pump sections 720 and 730 are arranged in series via conduit 740, and axial thrust from the pump sections tend to cancel each other out. This greatly reduces load on the thrust disk 760 and associated thrust bearings 762 and 764. According to some embodiments, pump system 700 can be arranged as a conventional, non-back-to-back design, with all impellers in line and a balance piston in drive end or non-drive end if required. The motor, motor shaft bearings (both radial and thrust bearings), flexible coupling, pump thrust bearings 762 and 764 and pump shaft radial bearing 728 are submerged in barrier fluid 780. The barrier fluid 780, which is conventionally supplied via a separate line 745 from topside through the umbilical will also cool and lubricate the drive end mechanical seal 770 that separates the volumes of barrier fluid 780 and process fluid 708. A higher pressure on the motor barrier fluid 780 compared to the process fluid 708 pressure will secure a continuous leak of barrier fluid into the process fluid over the mechanical seal 770. The barrier fluid 780 will be circulated by means of a circulation impeller assembled to the pump shaft through one or more barrier fluid cooling coils 744. By adding a bushing and a conduit 742 the process pressure at the mechanical seal will be equal to process suction pressure. This will provide a very stable barrier fluid pressure at the expense of slightly reduced efficiency. If the conduit 742 is removed, the barrier fluid pressure would need to be increased to more than half of the delta pressure over the pump during start up.

Figure 8:
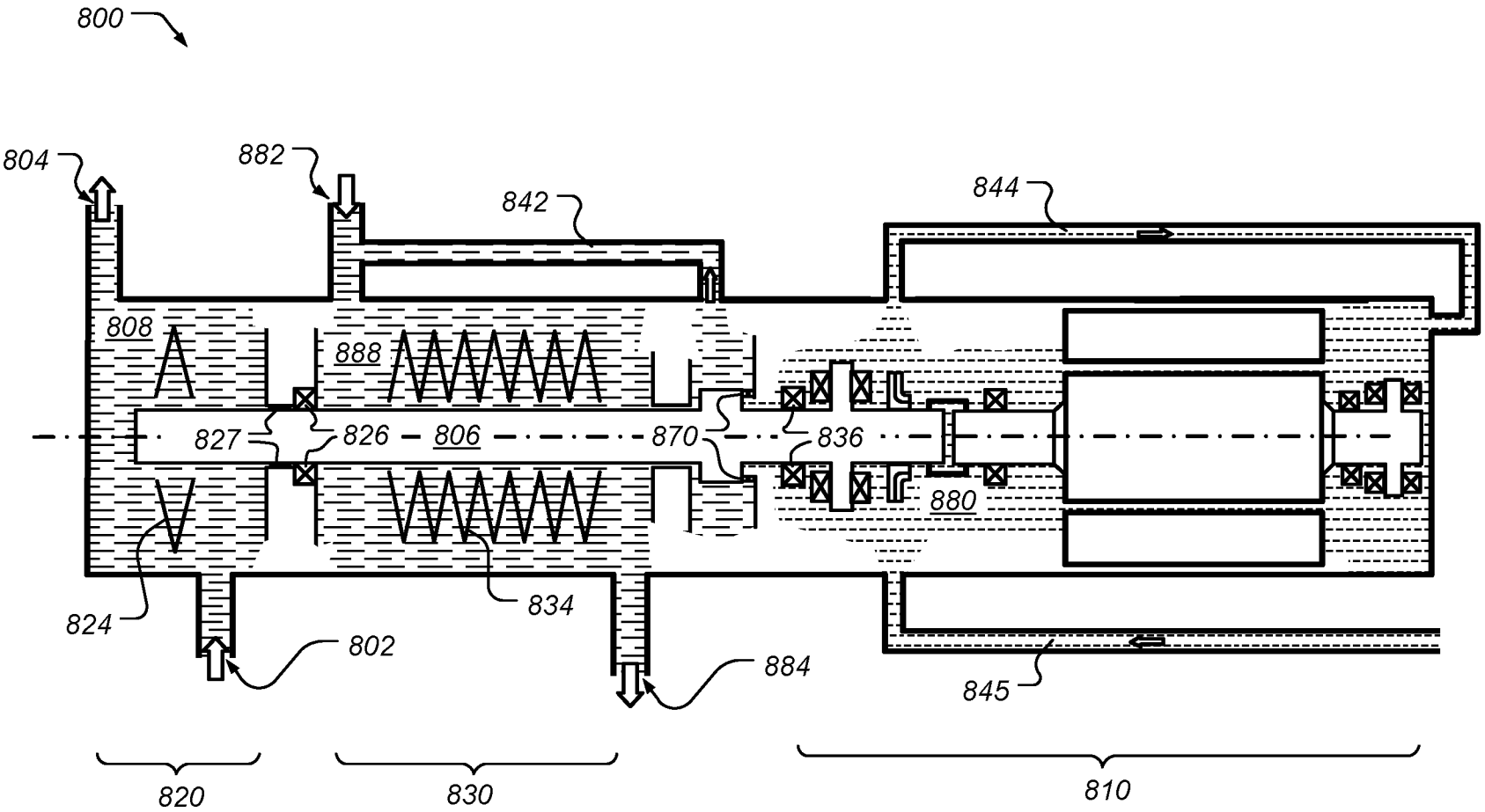
FIG. 8 is a schematic diagram illustrating aspects of a dual-pump subsea water injection pumping system that is partially process fluid lubricated and partially barrier fluid lubricated, according to some embodiments.

FIG. 8 is a schematic diagram illustrating aspects of a dual-pump subsea water injection pumping system that is partially process fluid lubricated and partially barrier fluid lubricated, according to some embodiments. Pump system 800 is similar to pump system 700 of FIG. 7 in that it has a process fluid (seawater) lubricated non-drive end radial bearing. Pump system 800 is also partially barrier fluid lubricated. Motor section 810 is submerged in barrier fluid 880. The barrier fluid is contained using mechanical seal 870. However, pump system 800 includes two separate pump sections that serve to pump two separate fluid streams. Pump section 820 has impellers 824 that drive process fluid 808 from inlet 802 to outlet 804. Similarly, pump section 830 has impellers 834 that drive process fluid 888 from inlet 882 to outlet 884. The radial position of shaft 806 is maintained using radial bearings 826 and 836. The two process fluids 808 and 888 are kept separate by wear ring 827.

Pump system 800 is essentially a pump made up of motor section 810 and pump section 830, with another pump section 820 assembled to the overhang part of a common pump shaft 806. By implementing an additional pump 820 inside a main pump (810 and 830), costs can be reduced substantially due to reduction of equipment such as power drives, HPU's, control cabinets, umbilical lines, subsea transformers, instrumentation, jumpers, space in subsea station, installation etc. The added pump 820 can, for example, be used as a feed pump or a reject flow pump for upstream filters or for cleaning of upstream filters. See the Co-Pending Application for further examples of multiple pumps driven by a common electric motor.

Figure 9:
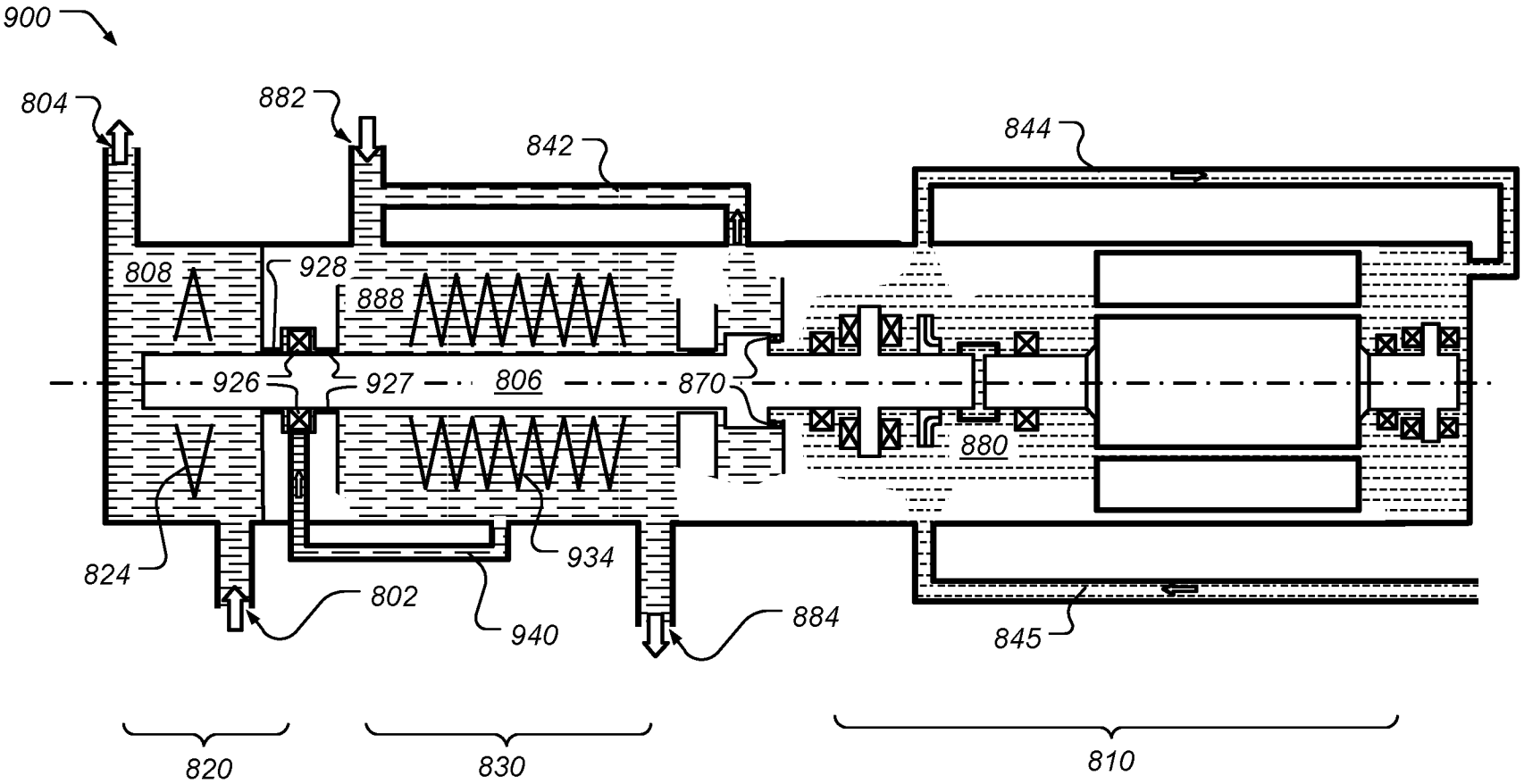
FIG. 9 is a schematic diagram illustrating aspects of a dual-pump subsea water injection pumping system, such as shown in FIG. 8, with two wear rings and a high pressure supply therebetween, according to some embodiments.

The non-drive end radial bearing 826 is process fluid lubricated and cooled. The two pump sections 830 and 820 are separated by one or more wear rings 827. The direction of the leakage over the wear ring 826 is determined by the pressure of the volumes facing the wear ring. In many cases it is desirable to have a distinct direction of this leakage, for example if the process cleanliness is different at the inlet for the two pump sections. In FIG. 8, the wear ring 826 is facing the inlet pressure for both of the pump sections 820 and 830. If there are different filter systems upstream of the two pump sections the pressure difference can be rather high. For example, in the case where a reverse osmosis membrane is located upstream from the main pump 830, the pressure differential can be about 80 bars. In the case where a nano filter or sub-micron filter is located upstream of the main pump 830, the pressure differential can be about 50 bars. If the impeller direction of the added pump section 820 is reversed, the pressure difference will increase further. If it is preferable to have a leak from the main pump 830 to the added pump 820 under these conditions, a process line can be routed from an impeller stage or the outlet of the main pump to a volume between two wear rings between the two pumps sections as shown in FIG. 9. As in the case of conduit 742 in FIG. 7, conduit 842 may be used if the delta pressure over pump section 830 is above the limits of the main thrust bearing. According to some embodiments, a balance piston (not shown) may be added to the pump shaft to reduce thrust forces. The leakage over the balance piston will be routed back to pump inlet 882. The barrier fluid 880, which is supplied via a separate line 845 from topside through the umbilical will also cool and lubricate the drive end mechanical seal 870 that separates the volumes of barrier fluid 880 and process fluid 888. A higher pressure on the motor barrier fluid 880 compared to the process fluid 888 pressure will secure a continuous leak of barrier fluid into the process fluid over the mechanical seal 870. The barrier fluid 880 is circulated by means of a circulation impeller assembled to the pump shaft through one or more barrier fluid cooling coils 844.

FIG. 9 is a schematic diagram illustrating aspects of a dual-pump subsea water injection pumping system, such as shown in FIG. 8, with two wear rings and a high pressure supply therebetween, according to some embodiments. Pump system 900 is the same as pump system 800 shown in FIG. 8, except that instead of a single wear ring 827, two wear rings 927 and 928 are included with a high pressure fluid supply being fed from conduit 940 to a location of bearing 926 which is between the wear rings 927 and 928. The high pressure fluid is drawn from a location mid-way along impeller stage 934, although the exact location will depend on the desired pressure to be supplied between the wear rings. By supplying a high pressure fluid source between the wear rings as shown, leakage of process fluid 808 into pump section 830 can be prevented despite a relatively high pressure differential between inlet 802 and inlet 882. An example of such a case is where pump section 820 is being used as a feed pump or reject flow pump and the pump section 830 is being used downstream of a nano filter, sub-micron filter or reverse osmosis filter. In such cases, it may be important to prevent fluid 808, which has not yet been filtered or is rejected fluid, from entering the flow stream of pump section 830, which has already been filtered. See the Co-Pending Application for further details of such an example.

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures.

What is claimed is:

1. A subsea process fluid lubricated water injection pumping system, comprising:

an elongated impeller shaft;

a motor section in which an electric motor is positioned, wherein the electric motor is configured to impart torque on the impeller shaft thereby causing the impeller shaft to rotate about a main longitudinal axis in a drive direction;

a first set of impellers fixedly mounted to the impeller shaft and configured to increase pressure of a single phase aqueous process fluid when the impeller shaft is rotated in the drive direction thereby imparting a first axial force on the impeller shaft in a first direction parallel to the longitudinal axis;

a second set of impellers fixedly mounted to the impeller shaft and configured to increase pressure of a the process fluid when the impeller shaft is rotated in the drive direction thereby imparting a second axial force on the impeller shaft in a second direction opposite to the first direction;

a pump section comprising a fluid inlet configured to receive the process fluid, and a fluid outlet, wherein the first set of impellers and the second set of impellers are positioned in the pump section;

a bushing positioned about the impeller shaft; and at least one bearing surface spaced from the bushing along the longitudinal axis and configured to allow the impeller shaft to rotate about the longitudinal axis, the at least one bearing surface further configured for lubrication and cooling from the process fluid via a leak path formed between the impeller shaft and the bushing and extending through a gap formed between a stator and a rotor of the electric motor;

a fluid conduit extending from the motor section to the fluid inlet of the pump section to recirculate the process fluid from the leak path to the fluid inlet;

wherein the leak path extends from the gap formed between the stator and the rotor of the electric motor into an inlet of the fluid conduit and wherein the first set of impellers are configured to pressurize the process fluid before the process fluid enters the leak path.

2. The system according to claim 1 wherein the system is configured such that during operation a net axial force on the impeller shaft resulting from a sum of the first and second axial forces has a magnitude of less than 50% of the greater magnitude of the first or second axial forces.

3. The system according to claim 2 wherein the system is configured such that during operation a net axial force on the impeller shaft resulting from a sum of the first and second axial forces has a magnitude of less than 75% of the greater magnitude of the first or second axial forces.

4. The system according to claim 1 wherein the system is configured for deployment on a seabed.

5. The system according to claim 1 wherein the process fluid comprises seawater.

6. The system according to claim 5 wherein the seawater is filtered to remove at least some particulate matter prior to entering the pumping system.

7. The system according to claim 5 wherein the seawater is filtered to remove particulate matter greater than 1 micron before being pressurized by at least one of the first or second sets of impellers.

8. The system according to claim 1 wherein the first and second sets of impellers are positioned on the same side of the electric motor.

9. The system according to claim 8 wherein the electric motor includes a rotor shaft that is attached to the impeller shaft with a coupling that is flexible in at least the axial direction.

10. The system according to claim 1 wherein the rotor is fixedly mounted to the impeller shaft.

11. The system according to claim 1 further comprising a second motor configured to impart torque on the impeller shaft thereby causing the impeller shaft to rotate in the drive direction.

12. The system according to claim 1 further comprising a thrust disk fixedly mounted to the impeller shaft having bearing surfaces that are lubricated with the process fluid.

13. The system according to claim 1 wherein the pumping system forms part of seawater injection system and the first and the second impeller stages are configured to inject seawater into a subterranean rock formation via a wellbore penetrating the formation.

14. The system according to claim 1 wherein all bearing surfaces are configured to be lubricated and cooled by at least the process fluid.

15. The system according to claim 1, wherein the leak path is at least partially formed radially between an inner surface of the bushing and an outer surface of the main shaft.

* * * * *